US005448953A

United States Patent [19]

Bieker et al.

[11] Patent Number: 5,448,953

[45] Date of Patent: Sep. 12, 1995

[54] RUNNING GEAR UNIT FOR LOW-FLOOR RAIL VEHICLES

[75] Inventors: Guido Bieker, Kirchhundem; Herbert Büdenbender, Netphen; Rene Tutzauer, Freudenberg; Alfred Lohmann, Siegen, all of Germany

[73] Assignee: ABB Henschel Waggon Union GmbH, Berlin, Germany

[21] Appl. No.: 153,298

[22] Filed: Nov. 16, 1993

[30] Foreign Application Priority Data

Nov. 16, 1992 [DE] Germany ..... 42 38 574.1

[51] Int. Cl.[6] ..... B61F 5/00

[52] U.S. Cl. ..... 105/158.2; 105/167; 105/169; 105/179; 105/199.1; 105/218.2; 105/224.1

[58] Field of Search ..... 105/158.1, 158.2, 165, 105/167, 168, 169, 170, 174, 179, 180, 182.1, 197.1, 218.2, 218.1, 223, 224.05, 224.06, 224.1

[56] References Cited

U.S. PATENT DOCUMENTS

| | | | |
|---|---|---|---|
| 2,056,652 | 10/1936 | Edmunds et al. | 105/180 |
| 2,059,963 | 11/1936 | Barrows | 105/224.05 |
| 2,614,508 | 10/1952 | Archambault | 105/224.05 |
| 2,968,258 | 1/1961 | Lich | 105/180 |
| 4,459,919 | 7/1984 | Lemaire et al. | 105/180 |
| 4,589,346 | 5/1986 | Miller | 105/224.05 |
| 5,042,394 | 8/1991 | DeRo et al. | 105/218.2 |
| 5,081,934 | 1/1992 | DeRo et al. | 105/218.2 |
| 5,235,918 | 8/1993 | Durand et al. | 105/218.2 |

FOREIGN PATENT DOCUMENTS

| | | | |
|---|---|---|---|
| 1438445 | 4/1966 | France | 105/168 |
| 1936932 | 2/1971 | Germany | 105/218.2 |
| 1595722 | 9/1990 | U.S.S.R. | 105/218.2 |

*Primary Examiner*—Mark T. Le

*Attorney, Agent, or Firm*—Herbert L. Lerner; Laurence A. Greenberg

[57] ABSTRACT

A running gear unit for low-floor rail vehicles includes a running gear frame on which individual wheels are rotatably mounted through a respective rocker and the rocker is articulatingly attached and supported by primary springs. The running gear frame is connected to a car body of the low-floor rail vehicle through two articulated rods having one end being articulatingly mounted at a distance from one another on a crossmember of the running gear frame and another end being likewise articulatingly attached to the car body. The car body is supported on the running gear frame through secondary springs being mounted in pockets near transverse ends of the crossmember. Transverse stops are disposed at a distance from one another in the crossmember for limiting transverse movement of the car body relative to the running gear unit. In order to construct the running gear unit in such a way that the floor area in the car body is at a continuous low level and the wheels of the running gear unit can be steered, the rocker is mounted on a horizontal axle disposed in the transverse direction of the running gear unit, on a bolster which is articulatingly secured about a vertical axis on the running gear frame.

10 Claims, 5 Drawing Sheets

RUNNING GEAR UNIT FOR LOW-FLOOR RAIL VEHICLES

BACKGROUND OF THE INVENTION

1. Field of the Invention

The invention relates to a running gear unit for low-floor rail vehicles including a running gear frame on which individual wheels are rotatably mounted through a respective rocker, the rocker is articulatingly attached and supported by primary springs, the running gear frame is connected to a car or carriage body of the low-floor rail vehicle through two articulated rods which are articulatingly mounted at one end at a distance from one another on a crossmember of the running gear frame and at the other end are likewise articulatingly attached to the car or carriage body, the car or carriage body of the low-floor rail vehicle is supported on the running gear frame through secondary springs which are mounted near the transverse ends on the crossmember, and transverse stops disposed at a distance from one another in the crossmember limit the transverse movement of the car or carriage body relative to the running gear unit.

Published European Application No. 0 384 512 discloses a running gear unit in which the frame of the running gear unit is constructed approximately in the shape of an H with a double crossmember. The double crossmembers are connected to one another at their transverse ends by outer longitudinal members which project slightly beyond the double crossmembers in the longitudinal direction of the running gear unit. Disposed between the double crossmembers is a transverse bolster beam which can be moved vertically and horizontally in the transverse direction. This transverse bolster beam is suspended at its transverse ends, through suspension rods, in secondary springs which are supported on outer longitudinal members of the running gear unit. In the center, the transverse bolster beam bears a receptacle for a pivot pin of the car or carriage body. Abutments, through which the car or carriage body is supported during cornering, are provided on the transverse bolster beam in the transverse direction of the running gear unit, on both sides of the receptacle for the pivot pin.

Near their longitudinal ends, the outer longitudinal members of the running gear frame carry individual wheels on rockers, the rockers are articulatingly attached to the outer longitudinal members and the rockers are supported relative to one another and on the running gear frame through primary springs.

The disadvantage of the above-mentioned structure is the configuration of a transverse bolster beam and its suspension on the secondary springs, which on one hand represents a complex construction and on the other hand requires such a great overall height in the region between the individual wheels of one longitudinal side of the running gear unit that the low-floor construction of the low-floor rail vehicle is compromised to a considerable extent, at least in that region, and it is not possible to use transverse seats. A further disadvantage of the already known construction resides in the fact that due to the guidance of the running gear unit on the car or carriage body by means of a pivot pin, additional hunting or side motion dampers are required for use in low-floor rail vehicles and they reduce the cost-effectiveness of the running gear unit.

Running gear units with individual wheels are furthermore known from Published European Application No. 0 129 772. In the case of that running gear unit, the individual wheels are likewise mounted on the frame of the running gear unit through rockers. However, the running gear unit in that prior publication is so tall in the region between the wheels of one longitudinal side of the running gear unit that it cannot be used for low-floor rail vehicles with a continuous car or carriage floor.

Individual wheels for running gear units for use in underground rail vehicles are furthermore known per se from German Published, Non-Prosecuted Application DE 35 38 513 A1. In that prior publication, the individual wheels are suspended on the car or carriage body through rockers.

Also known in practice are rockers for the articulated attachment of wheel axles for rail transport where the rockers are supported on the bogey or truck frame through springs.

SUMMARY OF THE INVENTION

It is accordingly an object of the invention to provide a running gear unit for low-floor rail vehicles, which overcomes the hereinafore-mentioned disadvantages of the heretofore-known devices of this general type, in which the low-floor nature of the car or carriage body is maintained in full and in which all that is present in the running gear unit in the region of the wheels are wheel guards that project into the car or carriage body and are disposed underneath seats in such a way that the car or carriage floor can be of continuous construction. A further object of the invention is to construct the wheels of the running gear unit in such a way that they are steerable.

With the foregoing and other objects in view there is provided, in accordance with the invention, a running gear unit for low-floor rail vehicles, comprising a running gear frame of a low-floor rail vehicle having a crossmember with transverse ends; bolsters being articulatingly secured about vertical axes on the running gear frame; horizontal axles disposed on the bolsters in transverse direction of the running gear unit; rockers articulatingly mounted on the horizontal axles; primary springs supporting the rockers; individual wheels each being rotatably mounted on the running gear frame by a respective one of the rockers; two articulated rods each having one end being articulatingly mounted at a distance from one another on the crossmember and another end to be articulatingly attached to a car body of the low-floor rail vehicle, for connecting the running gear frame to the car body; pockets in the vicinity of the transverse ends of the crossmember; secondary springs being mounted in the pockets for supporting the car body on the running gear frame; and transverse stops being disposed at a distance from one another in the crossmember for limiting transverse movement of the car body relative to the running gear unit.

Through the use of this construction of the running gear unit in accordance with the invention, both the region between the individual wheels of a longitudinal side of the running gear unit and the region between the individual wheels in the transverse direction of the running gear unit are kept free of tall elements. The car or carriage body of the low-floor rail vehicle can thus be of continuous construction, apart from the wheel guards, and without disruptive steps. A further advantage of the invention resides in the fact that the individual wheels are disposed in a horizontally swivellable manner on the running gear frame and a considerable reduction in wheel/rail wear and minimization of noise can be expected on the tight curves encountered in city running.

In accordance with another feature of the invention, the horizontal swivellability of the bolster relative to the running gear frame is cushioned and/or damped by springs and/or dampers disposed between the bolster and the running gear frame. The provision of springs and/or dampers prevents horizontal wobbling of the wheels and ensures that the bolster is returned with the individual wheel to the straight-ahead position.

In accordance with a further feature of the invention, the primary spring is constructed as a leaf suspension spring, with two leaf suspension springs being provided for each individual wheel, and these springs being disposed on both sides of a wheel tire in the longitudinal direction of the running gear unit, between the rocker and the bolster. The layout and construction of the primary spring as a leaf suspension spring between the rocker and the bolster ensures a low overall height, which is advantageous for the low-floor nature of the car or carriage body.

In accordance with an added feature of the invention, the rocker is constructed with a downwardly open cross-section and a U shape, and an axle for the individual wheel is disposed in a fixed manner in lateral cheeks of the rockers. Through the use of this structural layout of the rocker and the fixed configuration of the axle in the lateral cheeks of the rocker, the rocker is in the form of a statically stiff component which in turn has an advantageous effect on the running properties.

In accordance with an additional feature of the invention, the bolster is locked relative to the running gear unit by rigid elements disposed between the running gear frame and the bolster.

In accordance with yet another feature of the invention, the individual wheels of the running gear unit in each case are disposed in such a way as to be swivellable and locked together in pairs. The locking together of two adjacent individual wheels of the running gear unit may be advantageous under certain circumstances in a low-floor rail vehicle composed of a plurality of elements, each of which is supported by one or more running gear units, since with the individual wheels of the central running gear units locked together, higher speeds can be achieved in straight-ahead travel.

In accordance with yet a further feature of the invention, the bolsters or rockers or axles of the individual wheels disposed adjacent one another are connected by an axle support. In one variant embodiment of the invention the axle support is disposed in an articulated manner and in another embodiment of the invention the axle support is disposed in a fixed manner between the bolsters or rockers or axles of the individual wheels that are disposed adjacent one another.

In accordance with a concomitant feature of the invention, the axle is constructed as a polygonal shaft in the region of the lateral cheeks of the rocker and is mounted in a fixed manner in the lateral cheeks.

Other features which are considered as characteristic for the invention are set forth in the appended claims.

Although the invention is illustrated and described herein as embodied in a running gear unit for low-floor rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
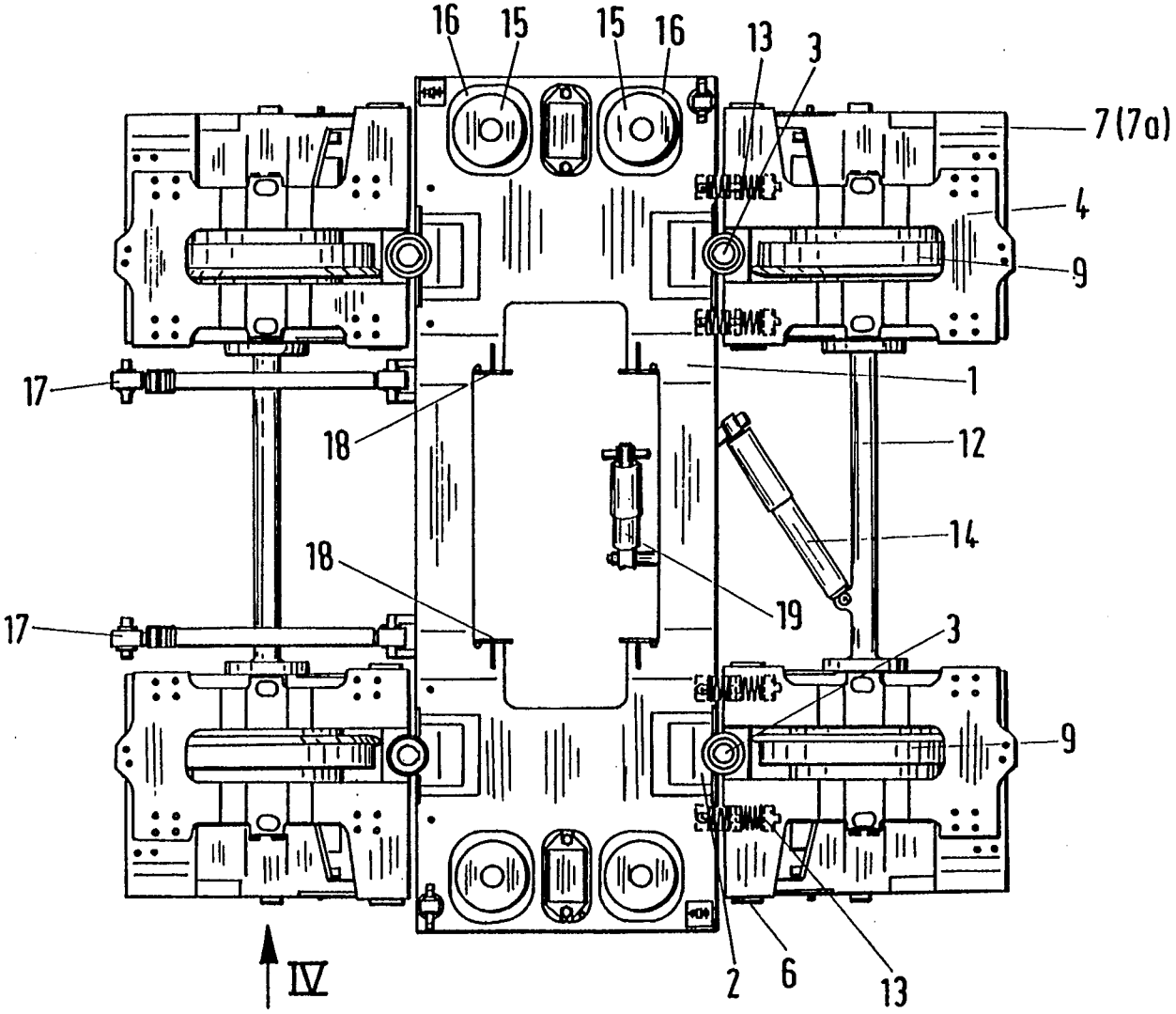
FIG. 1 is a diagrammatic, top-plan view of a running gear unit in accordance with the invention.

Referring now to the figures of the drawing in detail and first, particularly, to FIG. 1 thereof, there is seen a running gear frame of a running gear unit according to the invention, which is essentially formed of a crossmember 1. The crossmember 1 has a box-type layout with a flat construction. Upward-pointing brackets 2 are disposed in a fixed manner near transverse ends of the crossmember 1. Outer sides of the brackets 2 carry vertical bearings 3 for the reception of bolsters 4.

Figure 2:
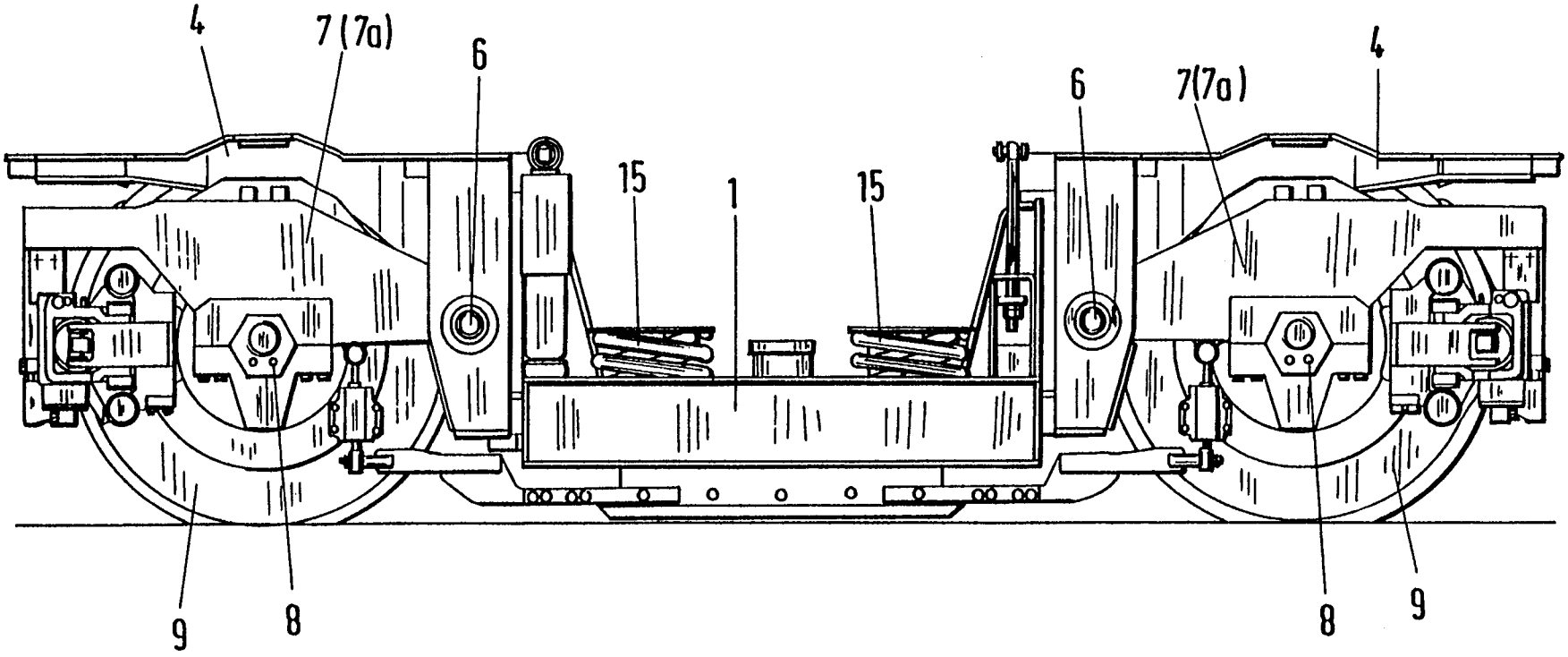
FIG. 2 is an enlarged side-elevational view of the running gear unit according to FIG. 1.
Figure 3:
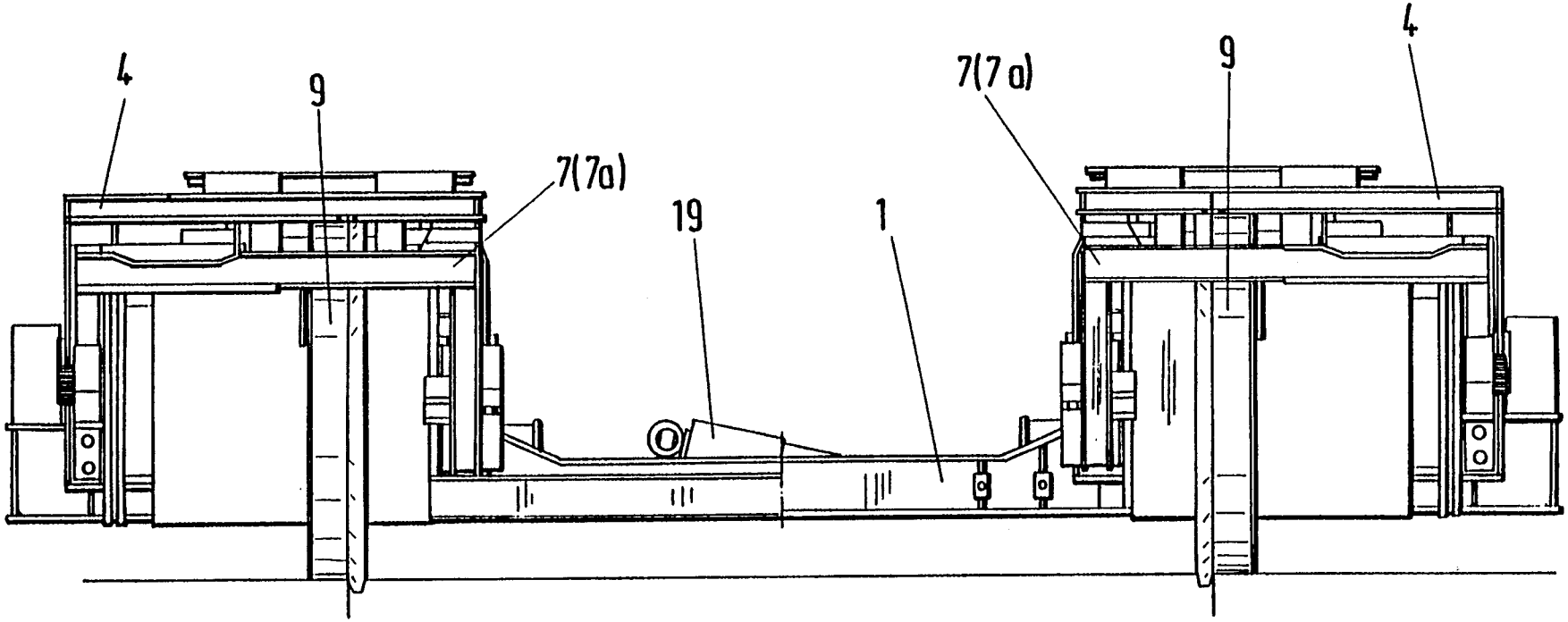
FIG. 3 is an end-elevational view of the running gear unit according to FIG. 1.
Figure 4:
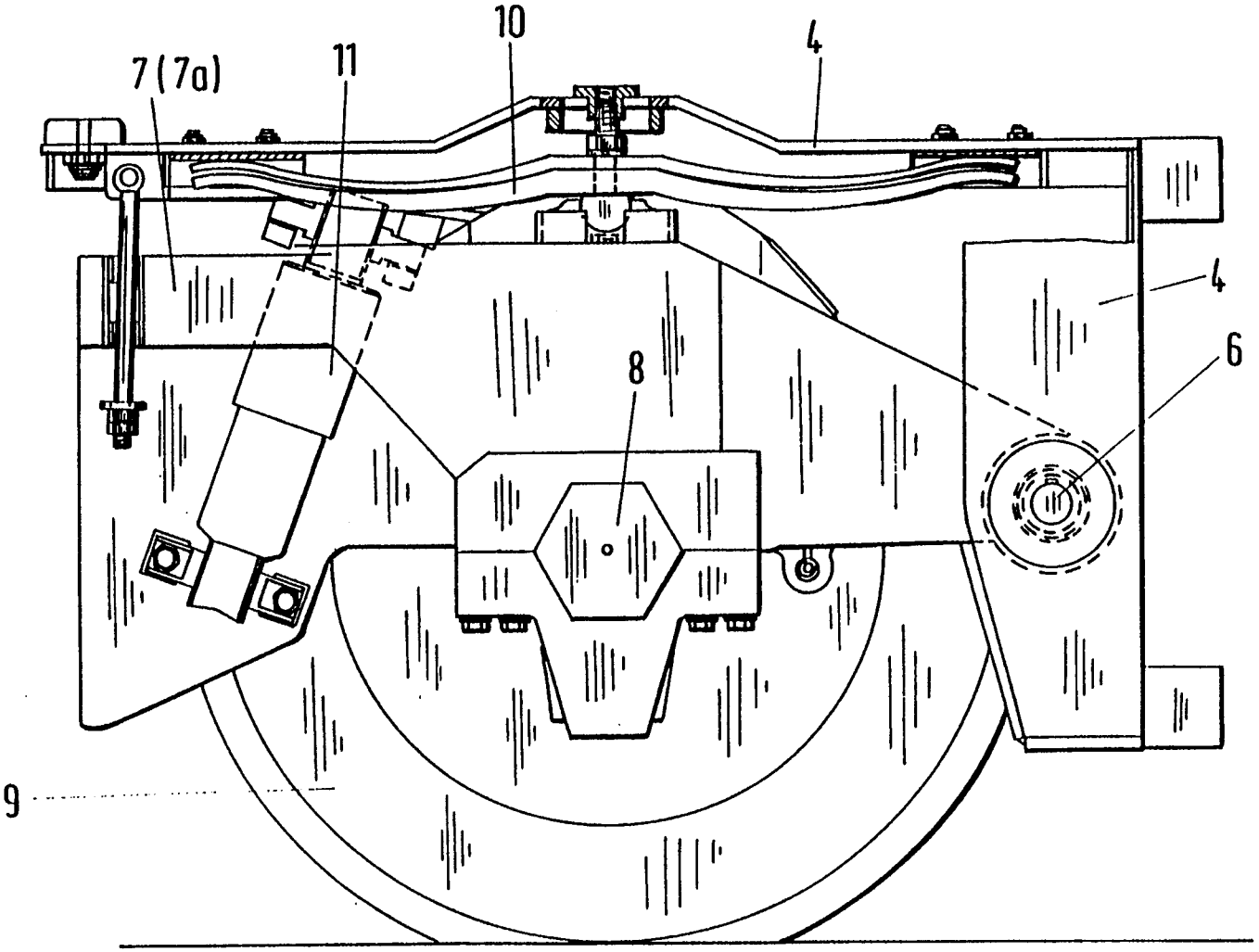
FIG. 4 is a further enlarged, side-elevational view taken in the direction of an arrow IV in FIG. 1.

As is best seen in FIGS. 2, 3 and 4, the bolsters 4 have an angular construction and a vertical limb, with which they are mounted in an articulated manner on the bearing 3 of the bracket 2. Disposed on the vertical limb of each bolster 4 is a horizontal bearing 6 in which a rocker 7 is mounted in a vertically movable manner. The rocker 7 has the cross section of a downwardly open U and has limbs or lateral cheeks 7*a* in which it fixedly carries a horizontal axle 8 on which an individual wheel 9 is rotatably mounted. In the region of the limbs 7*a* of the rocker 7, the axle 8 is constructed as a polygonal shaft and is clamped firmly in the limbs 7*a*.

Figure 5:
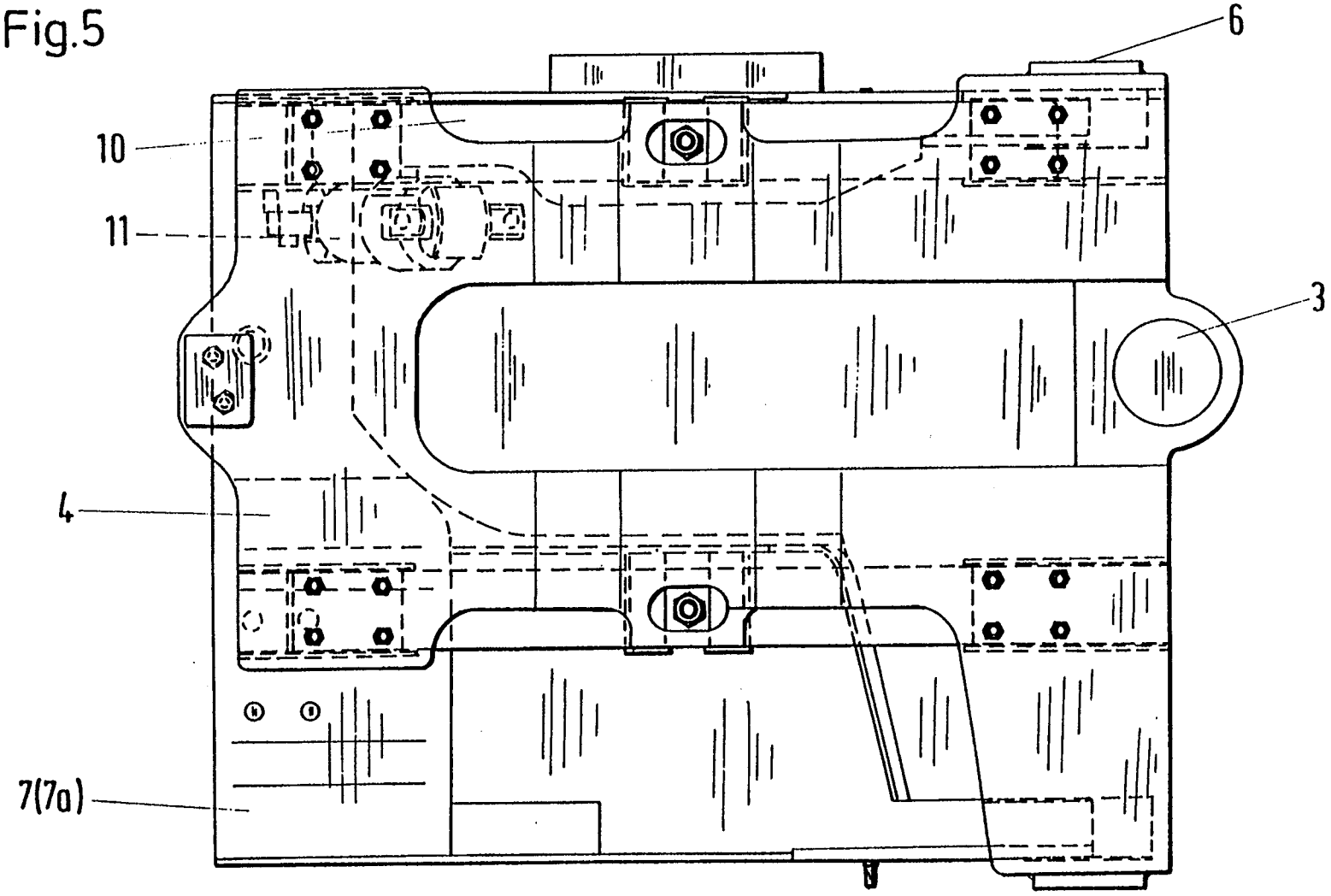
FIG. 5 is a top-plan view of the device according to FIG. 4.

As is seen in FIGS. 4 and 5, in each case a leaf suspension spring 10 is disposed on top of the rocker 7, on both sides of the individual wheel 9. The leaf suspension springs 10 are supported at the other end against the lower surface or underside of the free horizontal limb of the bolster 4. Dampers 11 disposed between the bolster 4 and the rocker 7 damp the vertical movements of the individual wheel 9. In each case an axle support 12 is disposed between the bolsters 4, the rockers 7 or the axles 8 of the adjacent individual wheels 9. The axle support 12 is likewise secured in an articulated manner on the bolsters 4, the rockers 7 or the axles 8, where the bolsters 4 are mounted in an articulated manner.

In a non-illustrated illustrative embodiment of the invention, in which the bolsters 4 are locked relative to the crossmember 1, i.e. in which they are disposed in a non-swivelling manner, the axle support 12 can be disposed in a fixed manner on the bolsters 4, the rockers 7 or the axles 8. In this illustrative embodiment of the invention, the bolsters 4 are locked relative to the crossmember 1 by measures that are of no significance to the invention, for example by welding or by the installation of rigid elements.

In the case of the illustrative embodiment depicted in the drawing, horizontal transverse movements of the bolster 4 relative to the crossmember 1 are cushioned or damped by springs 13 and dampers 14 that are attached on one hand to the bolster and on the other hand to the crossmember.

A non-illustrated car or carriage body is supported vertically on secondary springs 15 of the running gear unit. These secondary springs 15 are mounted in pockets 16 near transverse ends of the crossmember 1. One end of articulated rods 17 are attached to the crossmember 1 of the running gear frame in an articulated manner at a distance from one another. Other ends of the rods 17 are likewise articulated on the car or carriage body. The bearings of the articulated rods 17 are of spherical construction.

Transverse stops 18 are furthermore provided at a distance from one another in the crossmember 1, near the transverse center of the running gear unit. The stops interact with corresponding counterbearings of the car or carriage body and limit the transverse deflection of the car or carriage body relative to the running gear unit. Shock dampers 19 mounted between the crossmember 1 of the running gear frame and the car or carriage body serve to improve running behavior.

We claim:

1. A running gear unit for low-floor rail vehicles, comprising:

a running gear frame of a low-floor rail vehicle having a crossmember with transverse ends;

bolsters being articulatingly secured about vertical axes on said running gear frame;

horizontal axles disposed on said bolsters in transverse direction of the running gear unit;

rockers articulatingly mounted on said horizontal axles;

primary springs supporting said rockers;

individual wheels each being rotatably mounted on said running gear frame by a respective one of said rockers;

two articulated rods each having one end being articulatingly mounted at a distance from one another on said crossmember and another end to be articulatingly attached to a car body of the low-floor rail vehicle, for connecting said running gear frame to the car body;

pockets in the vicinity of said transverse ends of said crossmember;

secondary springs being mounted in said pockets for supporting the car body on said running gear frame; and transverse stops being disposed at a distance from one another in said crossmember for limiting transverse movement of the car body relative to the running gear unit.

2. The running gear unit according to claim 1, including springs disposed between said bolsters and said running gear frame for cushioning horizontal swivellability of said bolsters relative to said running gear frame.

3. The running gear unit according to claim 1, including dampers disposed between said bolsters and said running gear frame for damping horizontal swivellability of said bolsters relative to said running gear frame.

4. The running gear unit according to claim 1, including springs and dampers disposed between said bolsters and said running gear frame for cushioning and damping horizontal swivellability of said bolsters relative to said running gear frame.

5. The running gear unit according to claim 1, wherein said primary springs are leaf suspension springs, tires are disposed on said wheels, and two of said leaf suspension springs are disposed on both sides of one of said tires between said rocker and said bolster in longitudinal direction of the running gear unit, for each of said individual wheels.

6. The running gear unit according to claim 1, wherein said rockers have downwardly open U-shaped cross sections with lateral cheeks, and including axles each being fixedly disposed in said lateral cheeks of a respective one of said rockers for a respective one of said individual wheels.

7. The running gear unit according to claim 1, including axle supports articulatingly interconnecting said adjacent bolsters of said individual wheels.

8. The running gear unit according to claim 1, including axle supports articulatingly interconnecting said adjacent rockers of said individual wheels.

9. The running gear unit according to claim 6, including axle supports articulatingly interconnecting said adjacent axles of said individual wheels.

10. The running gear unit according to claim 6, wherein said axle is constructed as a polygonal shaft in the vicinity of said lateral cheeks of said rocker, and is fixedly mounted in said lateral cheeks.

* * * * *